US005275080A

United States Patent [19]

Stannard

[11] Patent Number: 5,275,080

[45] Date of Patent: Jan. 4, 1994

[54] WIND CHIMES HAVING PAIRED CHIME MEMBERS

[76] Inventor: John Stannard, Box 666, Crystal Beach, Fla. 34681

[21] Appl. No.: 839,529

[22] Filed: Feb. 20, 1992

[51] Int. Cl.[5] ..... G10D 13/08

[52] U.S. Cl. ..... 84/406; 84/410; 116/141; 116/169; D10/118

[58] Field of Search ..... 84/402, 403, 404, 406, 84/410; 116/141, 169; D10/118; D11/141

[56] References Cited

U.S. PATENT DOCUMENTS

| | | | |
|---|---|---|---|
| 864,461 | 8/1907 | Gibbs | 84/402 |
| 4,237,767 | 12/1980 | Levine | 84/406 |

*Primary Examiner*—Michael L. Gellner
*Assistant Examiner*—P. Stanzione
*Attorney, Agent, or Firm*—Joseph C. Mason, Jr.; Ronald E. Smith

[57] ABSTRACT

A windchime that generates musical tones in response to very low wind speeds includes chime members that are grouped in pairs. The chime members of each pair of chime members include a massive chime member and a less massive chime member that are closely spaced apart from one another. In very low winds, the less massive chime members begin swinging and impinge against their adjacent more massive chime members. Thus, a musical tone is produced even before the more massive chime members begin swinging. This arrangement of parts reduces the sensitivity threshold of the windchime so that it performs its intended function in breezes moving at less than one-half a mile per hour. In a preferred embodiment, three sets of chimes are suspended from a tripod-like mounting member that includes aesthetically pleasing support legs.

8 Claims, 2 Drawing Sheets

WIND CHIMES HAVING PAIRED CHIME MEMBERS

TECHNICAL FIELD

This invention relates to wind chimes. More particularly, it relates to a wind chime having a low activation threshold so that it produces musical notes at very low windspeeds.

BACKGROUND ART

There are two primary classifications of wind chimes; in the first classification, various articles are suspended from a common mount in a closely spaced group, and in the second classification, various articles are suspended in close proximity to a clapper means. The chimes of the first type produce musical notes when the individual chime members strike one another, and the chimes of the second type produce musical tones when the clapper strikes the chime members.

Typically, the chimes of the first type include multiple chime members arrayed in a linear configuration. Thus, each chime member strikes its continuous chime members when caused to swing relative to the mount by the wind. However, the chime members may be arrayed in alternate groupings as well, i.e., they may be grouped in a bundle so that each chime member is surrounded by additional chime members against which it may impinge when displaced by moving air particles.

The most common configuration for the second type of chimes includes plural chime members disposed in circumferential relation to a centrally disposed clapper. Typically, the clapper is suspended from the same mount as the individual chime members, and includes a means for catching air; in most designs, the means for catching air is a flat article that is suspended from the main clapper body, i.e., the part of the clapper that strikes the chime members. The chime members do not normally strike each other.

Both of these well-known types of chimes have drawbacks. Perhaps the most significant drawback of both types is that they may produce no musical tones at all in low winds. In the no-clapper designs where the chime members are disposed in linear array, if the wind approaches from a plane transverse to the longitudinal axis of the chime, all of the chime members may sway in that plane and may fail to impinge against one another. Moreover, in the no-clapper designs where the chime members are grouped in a bundle, the outermost chimes may sway and strike their contiguous chime members when the wind is blowing sufficiently hard, but the innermost chime members may remain silent because they are shielded from the wind. The only known no-clapper designs that are effective at low wind speeds include large wind-catching surfaces, such as seashells and the like. It has long been the conventional wisdom that cylindrical chime members, because they offer no large wind-catching surface, are not suitable for low windspeed applications.

In the chime designs having clappers, the wind-catching part thereof must be large enough to present a substantial wind-catching surface, and massive enough to cause displacement of the main clapper body because a very light wind-catching means offers little wind-resistance and thus does not transmit sufficient energy to the main clapper body. Thus, an effective wind-catching means has a substantial mass and does not swing in very low speed winds.

In most inhabited parts of the world, low speed winds are much more common then high speed winds. Significantly, very light breezes are the most frequent forms of wind, but all of the known wind chimes are incapable of adequately performing their intended function in such winds.

What is needed, then, is a wind chime design that produces pleasing musical tones even in the lightest of winds. The art, however, which is very old and well-developed, contains no teachings or suggestions as to how a more wind-sensitive chime could be produced.

DISCLOSURE OF INVENTION

A clapperless wind chime that produces musical tones at wind speeds as low as four-tenths of one mile per hour includes a plurality of pairs of chime members; each chime member in each pair of chime members is closely spaced with respect to its associated chime member, but each pair of chime members is more widely spaced from its contiguous pairs of chime members. Importantly, the mass of each chime member in a pair of chime members is different from the mass of its associated chime member. Accordingly, for each pair of chime members, the chime member having the lowest mass will respond to the wind prior to the response of the more massive chime member; the low mass chime member thus begins swinging and, due to its closely spaced relation to the more massive member, impinges against said more massive member and thus produces a musical tone. In the preferred embodiment, the chime members in a pair of chime members are spaced about one-sixteenth of an inch apart; the pairs of chime members, however, are spaced at conventional spacings from one another.

In a preferred embodiment of the invention, three rows of paired chime members are suspended from a mount having three legs of artistic curvature. Thus, each row of paired chime members follows the curvature of its associated leg; the subtle visual effect thereby achieved complements the equally subtle audio effects produced by the instrument, especially at low wind velocities. The overall aesthetic effect created by the visual and audial aspects of the invention have never before been achieved in a windchime.

An unexpected but beneficial side effect of the novel arrangement of parts is the lingering sound that it produces; long after a breeze has expired, the closely spaced chime members continue to impinge against each other, prolonging the listener's relaxation and thus enhancing the utility of the device.

An important object of this invention is to provide a wind chime that functions in the gentlest of breezes.

Another important object is to achieve the foregoing utilitarian object without sacrificing aesthetic considerations.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the invention.

BEST MODES FOR CARRYING OUT THE INVENTION

Figure 1:
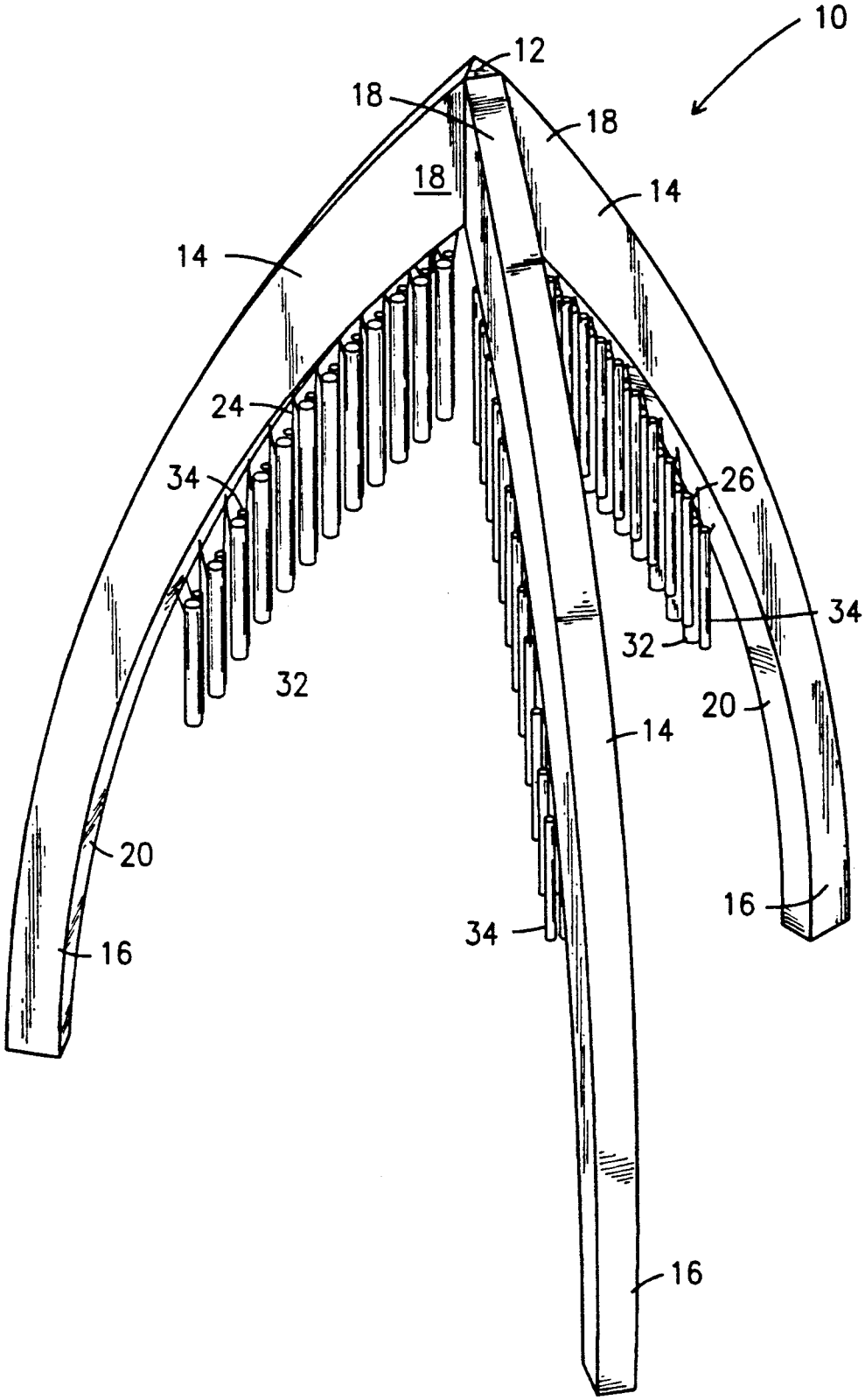
FIG. 1 is a perspective view of a first exemplary embodiment of the novel wind chime.

Referring now to FIG. 1, it will there be seen that an exemplary embodiment of the invention is denoted as a whole by the reference numeral 10. Wind chime 10 includes a vertically disposed truncate base member 12; in this particular embodiment, the transverse section of base 12 is triangular but other geometric configurations are within the scope of this invention.

A plurality of elongate, aesthetically curved legs, collectively denoted 14, supports base member 12. More particularly, each leg has a remote end 16 that is supported by a support surface such as the ground, preferably in a garden setting, and a proximal end 18 that is fixedly secured by suitable means to an associated flat surface of base member 12. Thus, legs 14 are radially arrayed with respect to base member 12.

Figure 3:
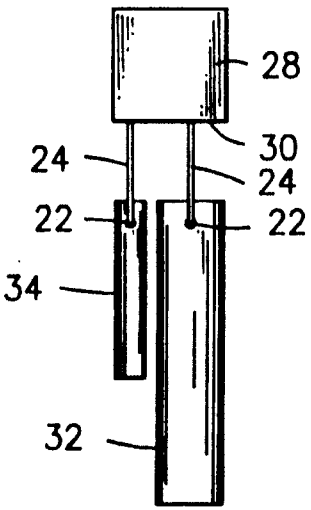
FIG. 3 is an end view of the embodiment of FIG. 2.

Each leg has an underside 20 from which the individual chime members are suspended. As best shown in FIG. 3, each chime member has a diametrically extending throughbore 22 formed therein near its uppermost end; the throughbore, preferably, is not omniscient with a node. A nylon thread 24 or other weather-resistant, strong cord means extends through each throughbore 22 and its opposite ends are fixedly secured to the underside of its associated leg by a tack member 26 or other suitable retaining means. In this manner, each chime member is individually suspended from its associated mount.

Figure 2:
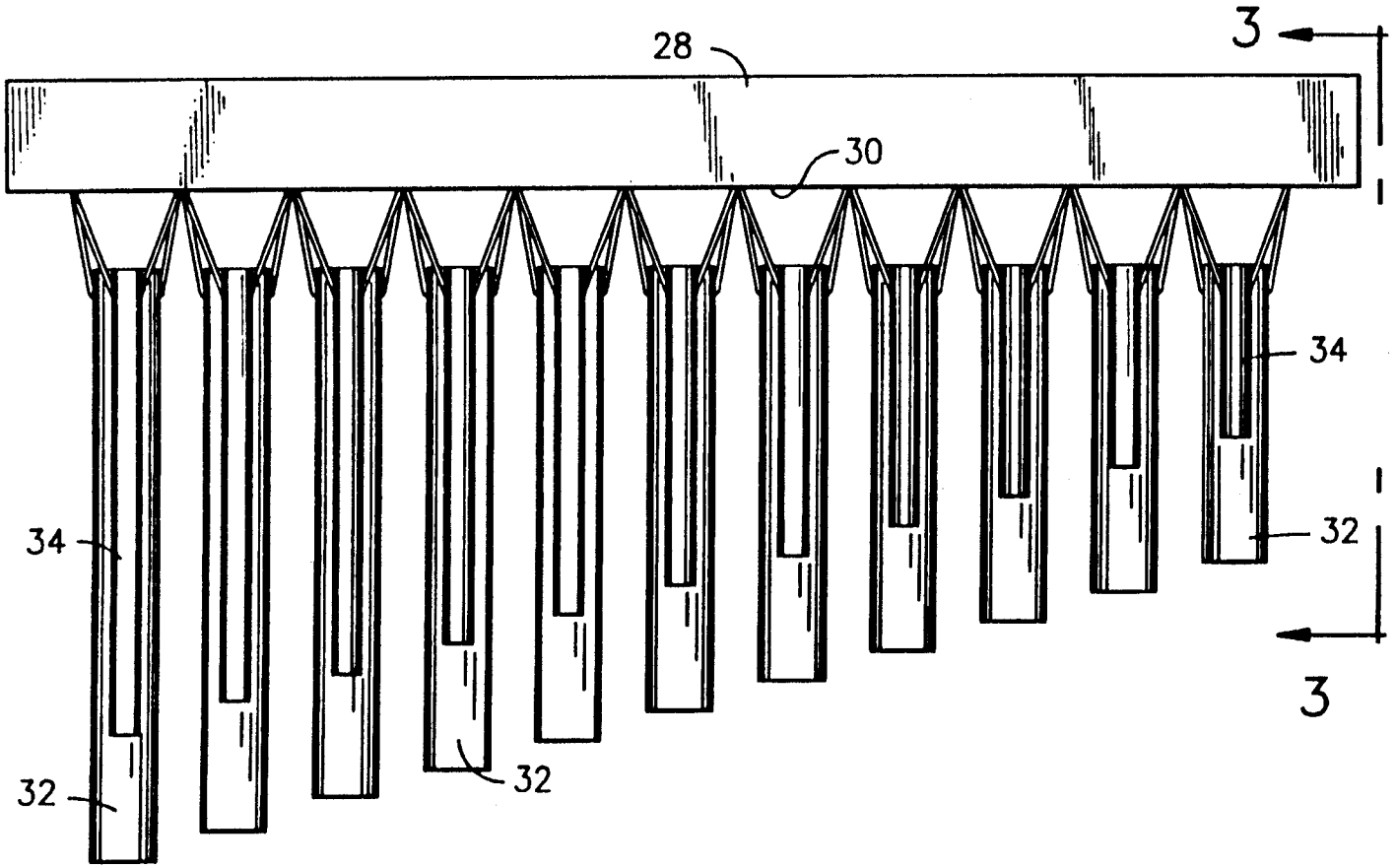
FIG. 2 is a side elevational view of a second embodiment.

Note in FIG. 1 that the throughbores 22 of the longitudinally spaced chime members are in general axial alignment with one another, i.e., they are aligned generally parallel to the arcuate longitudinal axis of their associated legs 14. In the embodiment of FIGS. 2 and 3, the throughbores 22 of longitudinally spaced chime members are in precise axial alignment with one another, and the throughbores of the paired, transversely spaced apart chime members are disposed in parallel alignment with one another as clearly shown in FIG. 3. Thus, the cord means 24 are in parallel relation to one another as well. Accordingly, laterally adjacent chime members of each pair of chime members are free to swing in a plane transverse to the longitudinal axis of symmetry of each throughbore 22.

It should be understood that FIGS. 2 and 3 depict a second embodiment where the novel chime members are arrayed in linear array instead of the curved array of the first embodiment; they are suspended from a straight mount 28 having a bottom wall 30 from which the paired chime members are suspended. It should be understood that any array of chime members is within the scope of this invention, i.e., the novel paired chime members could follow a serpentine path of travel, could be arrayed in a circular array, and so on. Moreover, a simple chime could be constructed by using only two paired chime members, although a multiplicity of paired chime members produces a fuller sound.

Each of the three sets of chimes in the first embodiment and each set of chimes in any other embodiment is a double row of closely spaced chime members. In the depicted embodiments, the more massive of the two chime members in each pair of chime members is denoted 32 and the less massive chime member is denoted 34. The spacing between the rows is preferably about one-sixteenth of an inch, but other effective close spacings are within the scope of this invention. It has been discovered that spacings substantially less than one-sixteenth of an inch produce an unpleasant buzzing noise. However, the term "close" is relative, of course. Where very large chime members are used, the spacing would increase. Thus, a thirty foot tall sculpture in a public park incorporating very massive chime members would call for a greater spacing, although such spacing would still be relatively close.

As best shown in FIG. 2, the longitudinal spacing between the pairs of chime members is conventional, i.e., on the order of a quarter inch or more in the small structure shown. Thus, longitudinally adjacent chime members will impinge against each other only in relatively high winds, as in conventional chimes. More importantly, the closely spaced apart individual chime members of each pair of chime members will impinge against each other in very light winds, as mentioned earlier, due to the difference in mass of the individual chime members as aforesaid.

In the preferred embodiment, the diameter of the larger chime member in each pair of chime members is about one-quarter inch whereas the diameter of the smaller chime member in each pair is about one-eighth inch; these diameters are not critical. Moreover, the diameter may vary as between the pairs of chime members since each pair of chime members produces a different musical tone than the other pairs. The ratio of diameters of the larger chime member in each pair of chime members to the smaller chime member in each pair is about 2:1 where both paired chime members have similar masses.

Similarly, the longer chime member in each pair of similar mass chime members is longer than its associated short chime member by a ratio of about 1.7:1; this ratio is not critical either.

Where one chime member is made of brass and its associated chime member is made of aluminum, e.g., both chime members may be the same size in view of the different masses of those materials.

The preferred ratio of the respective masses of the larger chime members relative to their smaller counterparts is about 1.3:1. However, many different ratios will work. Again, this mass ratio is not critical but it has been found effective to produce musical tones in breezes of less than one half mile per hour as mentioned earlier. Accordingly, even more sensitivity may be attained by increasing the mass ratio.

Although the present invention was designed to function in low winds, the final design yielded an unexpected result: long after the air has become still, the chimes continue to generate musical tones. Even more unexpectedly, the tones generated have a haunting, mystical quality perhaps best described by the word "shimmering." The shimmering sound seems to continue forever as it fades almost imperceptibly, leading the listener into a state of mental tranquillity.

This invention is clearly new and useful. Moreover, it was not obvious to those of ordinary skill in this art at the time it was made, in view of the prior art considered as a whole as required by law. As mentioned earlier, the art has long taught that clapperless designs having cylindrical chime members were unsuitable for use in low windspeed environments.

Moreover, this invention pioneers the art of ultrasensitive windchimes; closely spaced pairs of individual chime members were heretofore unknown, anywhere in the world. Accordingly, the claims that follow are entitled to broad interpretation, as a matter of law, to protect from piracy the heart or essence of this breakthrough invention.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A windchime, comprising: a mounting means of predetermined longitudinal extent;

a plurality of pairs of chime members disposed at substantially equidistantly spaced intervals along the extent of said mounting means;

each pair of chime members of said plurality of pairs of chime members including a first chime member and a second chime member;

each pair of chime members being longitudinally spaced apart from contiguous pairs of chime members by a predetermined longitudinal distance;

said first and second chime members of each pair of chime members being transversely spaced apart from one another, relative to a longitudinal axis of said mounting means, by a predetermined transverse distance;

said predetermined longitudinal distance between contiguous pairs of chime members being substantially greater than the predetermined transverse distance between chime members of the same pair of chime members so that a light wind blowing in a direction substantially coincident with the longitudinal axis of said mounting means does not cause longitudinally spaced apart contiguous pairs of chime members to impinge against one another;

each first chime member of each pair of chime members having a predetermined quality different from a predetermined quality of its associated second chime member so that said first and second chime members respond differently to wind and contact one another as a result of said different response;

suspension means for individually suspending from said mounting member each chime member in each pair of chime members;

said predetermined transverse distance being sufficiently small to cause the second chime member in each pair of chime members to impinge against its associated first chime member in response to a very light breeze blowing in a direction that is generally transverse to said longitudinal axis of said mounting means, to thereby create a musical tone and said predetermined transverse distance being sufficiently large to avoid generation of a buzzing tone during said very light breeze.

2. The windchime of claim 1, wherein said predteremined distance is about one-sixteenth of an inch.

3. The windchime of claim 2, wherein the predetermined quality of each first chime member in each pair of chime members is different from the predetermined quality of its associated second chime member by a ratio of about 1:3:1.

4. The windchime of claim 3 further comprising:

a first diametrically extending throughbore formed in each first chime member of each pair of chime members and a second diametrically extending throughbore formed in each second chime member of each pair of chime members;

each of said first throughbores being in parallel alignment with each of said second throughbores when said plurality of pairs of first and second chime members are suspended from said mounting means.

5. The windchime of claim 4, further comprising:

a plurality of first cord means, each of said first cord means being axially received within an associated first throughbore of said plurality of first throughbores;

each of said first cord means having opposite ends fixedly secured to said mounting means to thereby suspend each of said first chime members from said mounting means;

a plurality of second cord means, each of said second cord means being axially received within an associated second throughbore of said plurality of second throughbores; and each of said second cord means having its opposite ends fixedly secured to said mounting means to thereby suspend each of said second chime members from said mounting means, each of said first and second cord means being disposed in parallel relation to one another.

6. A windchime, comprising:

a truncate base member having a transverse cross section of predetermined geometric configuration;

a plurality of generally upstanding leg members, each of which has a proximal end secured to said base member and a remote end supported by a support surface;

a plurality of chimes suspended from each of said leg members along a predetermined extent thereof;

each chime of said plurality of chimes including a first plurality of chime members having a first predetermined mass and a second plurality of chime members having a second predetermined mass;

each chime member of said first plurality of chime members being paired with an associated chime member of said second plurality of chime members and being transversely spaced therefrom by a predetermined distance, said predetermined distance being sufficiently small to cause generation of a musical tone in response to low wind speed-induced swinging of at least one of said chime members of said second plurality of chime members, and being sufficiently large to avoid generation of a buzzing tone; and each chime member of said first plurality of chime members having more mass than its associated chime member of said second plurality of chime members.

7. The windchime of claim 6, further comprising a diametrically extending throughbore formed in each of said chime members of said first and second pluralities of chime members, each of said throughbores being in substantial parallel alignment with its associated leg member.

8. The windchime of claim 7, further comprising a plurality of cord means, there being as many cord means as there are throughbores, and a cord means extending through each of said throughbores, each of said cord means having its opposite ends fixedly secured to its associated leg member so that its associated chime member is free to swing in a plane transverse to its associated cord means.

* * * * *

UNITED STATES PATENT AND TRADEMARK OFFICE

CERTIFICATE OF CORRECTION

PATENT NO. : 5,275,080

DATED : 01/04/94

INVENTOR(S) : John Stannard

It is certified that error appears in the above-indentified patent and that said Letters Patent is hereby corrected as shown below:

Column 6, line 12 should read --of about 1.3:1--

Signed and Sealed this

Thirty-first Day of May, 1994

Bruce Lehman

*Attest:*

BRUCE LEHMAN

*Attesting Officer*

*Commissioner of Patents and Trademarks*